United States Patent [19]

Purcell

[11] Patent Number: 4,624,592

[45] Date of Patent: Nov. 25, 1986

[54] RIBBON CARTRIDGE RETENTION

[75] Inventor: Billy D. Purcell, Austin, Tex.

[73] Assignee: International Business Machines Corporation, Armonk, N.Y.

[21] Appl. No.: 617,421

[22] Filed: Jun. 5, 1984

[51] Int. Cl.[4] ..... B41J 32/00

[52] U.S. Cl. ..... 400/208; 400/196.1

[58] Field of Search ..... 400/207, 208, 208.1, 400/194, 195, 196, 196.1

[56] References Cited

U.S. PATENT DOCUMENTS

| | | | |
|---|---|---|---|
| 3,349,887 | 10/1967 | Goff, Jr. | 400/208 |
| 3,889,795 | 6/1975 | Garberi et al. | 400/208 |
| 3,904,017 | 9/1975 | Frechette | 400/208 X |
| 4,010,839 | 3/1977 | Guerrini et al. | 400/207 |
| 4,156,572 | 5/1979 | Carena | 400/196 |
| 4,302,118 | 11/1981 | Schaefer | 400/208 |
| 4,325,645 | 4/1982 | Miyajima et al. | 400/208 X |
| 4,330,218 | 5/1982 | Habich et al. | 400/144 |
| 4,339,210 | 7/1982 | Craft et al. | 400/208 |
| 4,352,578 | 10/1982 | Dunning et al. | 400/207 X |
| 4,359,288 | 11/1982 | Bullock | 400/208 |
| 4,368,992 | 1/1983 | Gagnebin | 400/196 |
| 4,408,914 | 11/1983 | Ciesiel et al. | 400/208 |
| 4,512,674 | 4/1985 | Suzaki et al. | 400/208 |

FOREIGN PATENT DOCUMENTS

| | | | |
|---|---|---|---|
| 0207083 | 12/1982 | Japan | 400/208 |
| 0219082 | 12/1983 | Japan | 400/208 |

OTHER PUBLICATIONS

IBM Technical Disclosure Bulletin, "Cartridge-Release Mechanism", Jenkins, vol. 22, No. 3, Aug. 1979, pp. 876–879.

IBM Technical Disclosure Bulletin, "Cartridge Clamping with Breakage Prevention", Crowe et al., vol. 26, No. 1, Jun. 1983, pp. 95–98.

IBM Technical Disclosure Bulletin, "Lever and Retaining Assembly for Ribbon Cartridges", Jenkins, vol. 27, No. 4A, Sep. 1984, pp. 1860–1862.

Xerox Disclosure Journal, "Ribbon Cartridge Clamp", Frechette, vol. 1, No. 8, Aug. 1976, p. 31.

IBM Technical Disclosure Bulletin, vol. 23, No. 9, Feb. 1981, "Ribbon Cartridge Latch", Bullock et al, pp. 3952–3954.

*Primary Examiner*—Ernest T. Wright, Jr.

*Attorney, Agent, or Firm*—Andrea P. Bryant

[57] ABSTRACT

For the retention of a ribbon cartridge (1) on a carrier (2) in a printer or a typewriter or the like, a flexible retaining arm (3) is disclosed. This retaining arm (3) is attached to carrier (2) and stands upright from it. Arm (3) includes a protruding leg (12) underneath cartridge (1) and a tenon (8) adapted to snap back into a recess (7) in cartridge (1) after deflection of retaining arm (3). On its opposite side cartridge (1) is supported with its trunnion (5) in a hole in a fixed retaining arm (6) of carrier (2). Trunnion (5) and tenon (8) are arranged on tilting axis (4) which is parallel to the print line. Upon loading cartridge (1) on carrier (2) protruding leg (12) is biased so that upon removal of cartridge (1) protruding leg (12) urges cartridge (1) upwardly. Retaining arm (3) with its protruding leg (12) is made of spring steel in leaf spring form.

11 Claims, 5 Drawing Figures

RIBBON CARTRIDGE RETENTION

TECHNICAL FIELD

The present invention relates to a ribbon cartridge retention means and more specifically to a means for holding an ink ribbon cartridge detachably in place on a carrier of a printer, typewriter or the like. The ribbon cartridge is tiltable around an axis parallel to the print line and comprises a trunnion on one side and holding means on the opposite side whereby the trunnion and the holding means are centered to the tilting axis.

BACKGROUND ART

U.S. Pat. No. 4,302,118 describes a ribbon cartridge that is attached to a carrier and that is tiltable about an axis parallel to the print line of a typewriter. The ribbon cartridge comprises a trunnion on one side and holding means on the opposite side of the cartridge. Both the trunnion and the holding means are arranged symmetrically in relation to the tilting axis. The mentioned holding means comprises two holes provided in two protruding ears on the one side of the cartridge, each hole equally distanced from the tilting axis. Inserting the cartridge into place calls for placing those two holes into fingers provided on the carrier and then lowering the cartridge so that the trunnion is caught by a slidable latch. Once placed on the carrier, the cartridge can be tilted around its tilting axis by moving up and down those fingers that are fixed inserted in the holding holes. The tilting serves the purpose to present different parts of a wider ribbon for use by the imprinting type font. It is also possible to provide print line visibility by tilting it out of an observer's eyesight to render the printed item visible for the operator. Furthermore, if a correcting cartridge is attached to the ink or print ribbon cartridge, the ink ribbon can be tilted out of the way and instead the lift-off ribbon can be presented to the imprinting type font. These different tilting procedures are controlled by a ribbon lift mechanism in an extent that is in accordance with the intended needs and purposes. The procedure to insert a cartridge onto the carrier and to remove it later on from that carrier is rather cumbersome and relatively time consuming. Moreover, the mechanical construction comprises many parts and is rather complicated and bulky.

A ribbon cartridge latch is described in *IBM Technical Disclosure Bulletin,* Vol. 23, No. 9, February 1981, pages 3952–3954. This latch is of a special structure and permits the trunnion of a ribbon cartridge to be inserted at an angle and then pivoted into a position perpendicular to the latch with a minimum clearance between the cartridge trunnion in the receiving hole of the latch. How the opposite side of the cartridge is held down onto the carrier and secured to it is not described in that article.

DISCLOSURE OF THE INVENTION

The main object of the present invention is to provide a cartridge retaining means that in itself is of a simple construction, is effective and simple to use, and that is easy to install. This retaining means should also provide for very easy loading of the cartridge onto the carrier as well as easy removal. Furthermore, this retaining means should provide exact positioning of the cartridge relative to the carrier in order to ensure quality printing, whereby it should be noted and considered that this retaining means has to permit and provide for the possibility of the tilting movement of the cartridge in order to render print line visibility possible These and other objects are advantageously accomplished in accordance with the invention basically in that the retention means includes a leaf spring that is fixed to the carrier and stands essentially upright from the carrier to form a holding arm. A tenon is provided on the holding arm and the tilting axis. This tenon snaps into a recess of the cartridge when it is inserted in place on the carrier whereby the tenon is first bent out of the way against the biasing force of the leaf spring holding arm. The leaf spring includes a protruding leg that presses in such a way against the installed cartridge that it biases the tenon against the cartridge recess, and upon removing the cartridge provides a lifting force to push the cartridge out of place when the tenon is removed from the cartridge's recess by bending the biasing holding arm away from the cartridge.

In accordance with the preferred embodiment, the leaf spring comprises a U-shaped base which together with the holding arm and the protruding lifting leg is made out of one piece of spring steel. Advantageously, the protruding lifting leg includes an angle with the cartridge tilting axis such that the cartridge is biased with a momentum of rotation preferably to lift the ribbon exposing part that is close to the print line.

In order to facilitate assembling and to prepare for automatic assembling, the carrier is advantageously provided with a recess in which the U-shaped base of the leaf spring is confined and preferably shaped such that the spring is kept in place and positioned exactly by simple insertion and without further fixing means.

To facilitate operation of the holding arm by the operator, there is provided a handle on top of the holding arm in accordance with another advantageous embodiment of the present invention. This handle can also carry the tenon. Preferably it is made out of plastic material cast around the upper part of the holding arm, also incorporating the tenon.

BRIEF DESCRIPTION OF THE DRAWING

In the following, the invention will be described in detail in connection with the accompanying drawing showing an embodiment of the invention, in which.

BEST MODE FOR CARRYING OUT THE INVENTION

Figure 1:
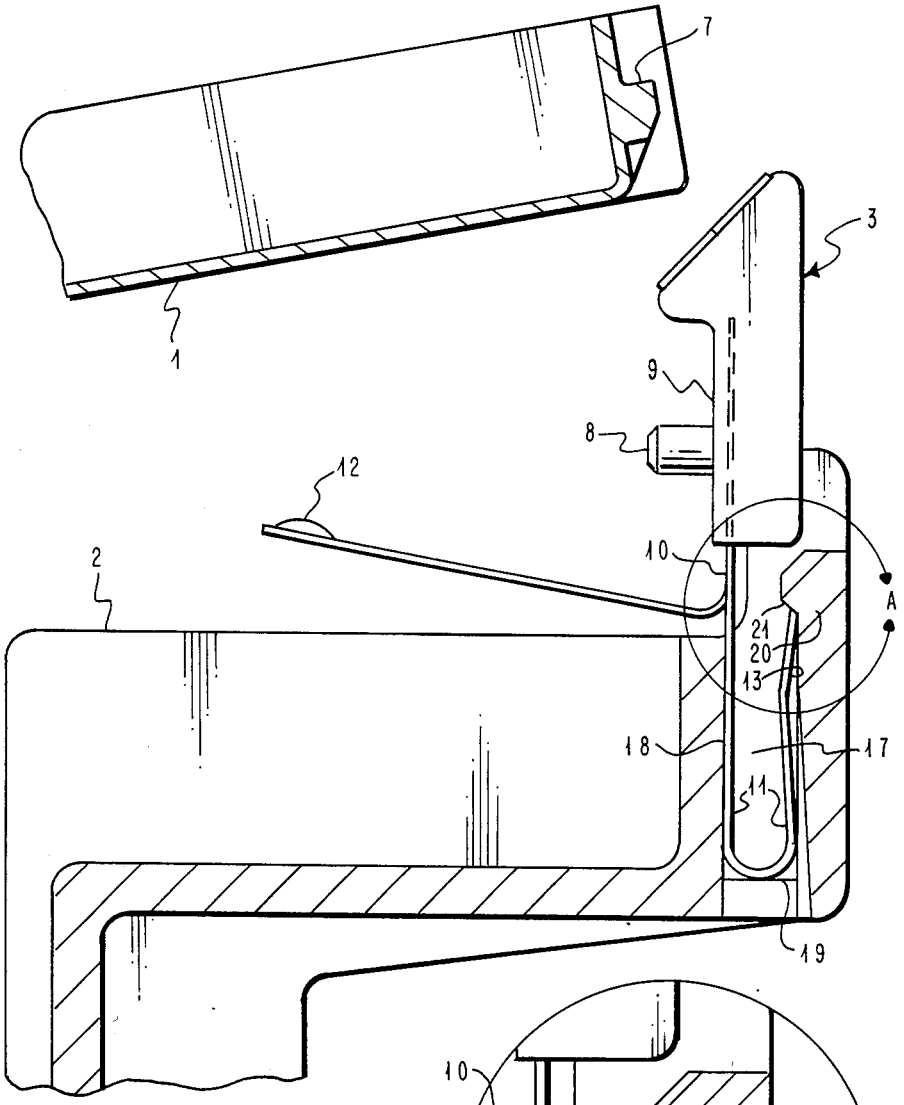
FIG. 1 is a sectioned view taken along the tilting axis showing part of the cartridge and part of the carrier with the retaining means installed, in the process of cartridge insertion.
Figure 2:
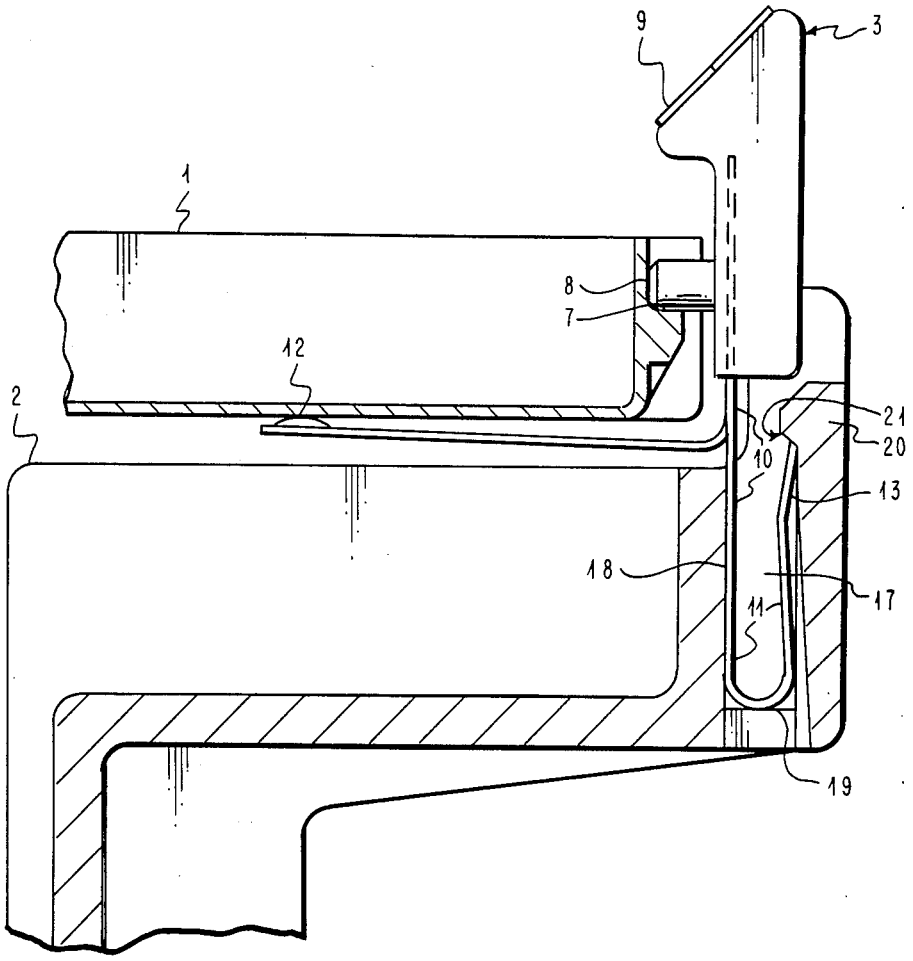
FIG. 2 is a partial sectioned view similar to the one shown in FIG. 1 but with the cartridge part shown in place on the carrier and the holding arm with its tenon holding the cartridge in place.
Figure 3:
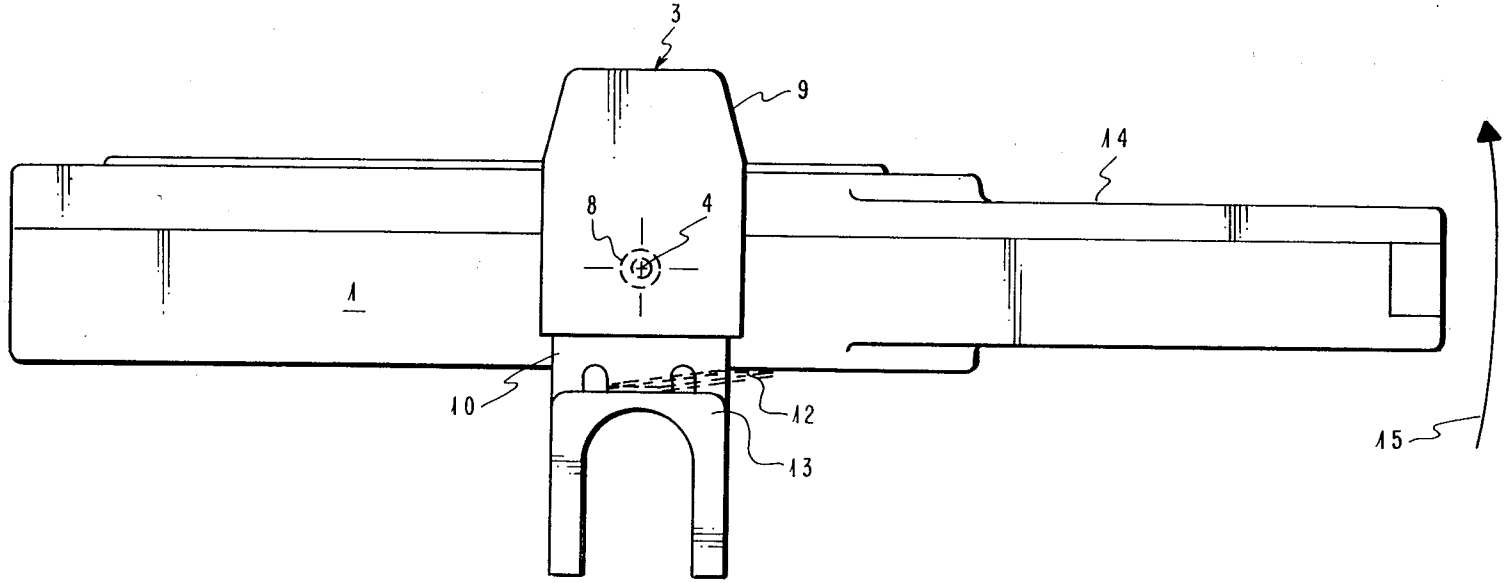
FIG. 3 is a side view, showing schematically the cartridge and the retaining spring with its handle.
Figure 4:
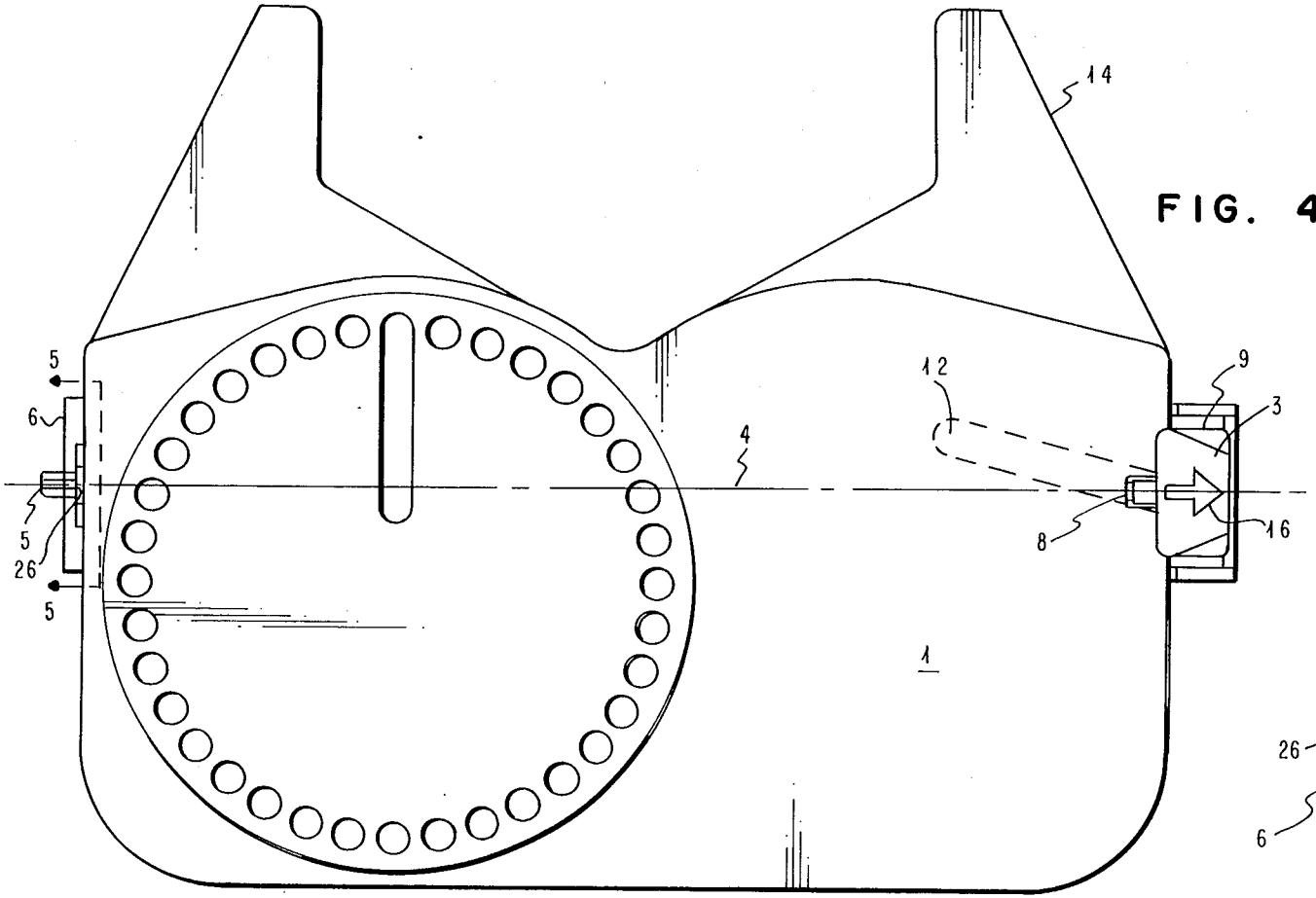
FIG. 4 is a top view, showing schematically the cartridge in whole with its trunnion on one side confined in an associated fixed holding arm and on the opposite side the flexible retaining arm in accordance with the present invention holding the cartridge in place and tiltable around an axis parallel to the print line.
Figure 5:
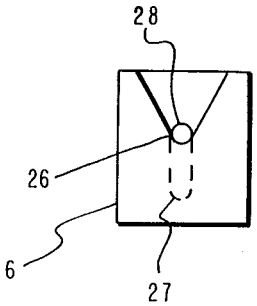
FIG. 5 is an end view of fixed retaining arm 6 showing the configuration of the opening therein.

FIG. 1 schematically depicts a sectional view along an axis (4 in FIG. 4) around which a ribbon cartridge 1 is tiltable. The view shows part of carrier 2 of a printer that is not shown, and part of cartridge 1. Cartridge 1 is shown in inclined position above carrier 2 in the state of being lowered onto and put into place on the carrier 2. FIG. 2 shows a similar view as FIG. 1 with cartridge 1 put in place on carrier 2 and retained there by flexible retaining arm 3. FIG. 3 shows schematically cartridge 1 and retaining arm 3 in a side view. FIG. 4 shows cartridge 1 from the top. Cartridge 1 is tiltable around axis 4. Centered to that axis 4 is a trunnion 5 attached on one side to cartridge 1. As seen in FIGS. 4 and 5 trunnion 5 is confined in a hole 26 of a fixed arm 6 that stands upright from carrier 2. On the opposite side cartridge 1 comprises a recess 7 best seen in FIGS. 1 and 2, into which a tenon 8 fits when cartridge 1 is snapped into position on carrier 2. Tenon 8 is attached to handle 9 that forms the upper part of flexible retaining arm 3.

In the following the flexible retaining arm 3 and its attachment to carrier 2, as constructed in accordance with the present invention and its best mode of operation, is described in more detail. Basically, flexible retaining arm 3 comprises an upright holding arm 10 with a U-shaped base 11 and a protruding leg 12. Protruding leg 12 extends from upright holding arm 10 toward the center of carrier 2 so that it is underneath cartridge 1. Holding arm 10, base 11 and protruding leg 12 are made preferably in one piece out of spring steel in the form of a leaf spring. U-shaped base 11 is formed by bending a prolonged extension of holding arm 10 in reverse direction relative to holding arm 10 such that a short outer leg 13 is generated. Protruding leg 12 is cut out of holding arm 10 as best seen in FIGS. 1–3, especially FIG. 3, and bent off from holding arm 10.

As can be seen in FIGS. 3 and 4 protruding leg 12 includes an angle with tilting axis 4 such that it protrudes toward the ribbon exposing part 14 of cartridge 1. By this design cartridge 1 is imparted with a rotary momentum in the direction of arrow 15. Thus the part of cartridge 1 which is remote from ribbon exposing part 14 and which is of the other side of tilting axis 4 is pushed downward toward carrier 2. With the help of this design a definite position of ribbon exposing part 14 is secured and also of the ribbon itself relative to the printer's print line when motion of cartridge 1 is limited by a stop (not shown).

As can be best seen in FIG. 1, protruding leg 12 includes in its unstressed state a larger angle with carrier 2 then in the stressed state, shown in FIG. 2. When cartridge 1 is installed in position on carrier 2, with tenon 8 snapped into recess 7 of cartridge 1, then protruding leg 12 is bent down. Thus, being resilient, protruding leg 12 exerts biasing pressure on the bottom of cartridge 1 in an upward direction. This in turn presses recess 7 firmly against the lower part of tenon 8 to positively position cartridge 1 in place. As holding arm 10 with tenon 8 on handle 9 in its upper part is connected resiliently to protruding leg 12, this biasing force urges tenon 8 in a counterclockwise direction and pushes cartridge 1 to the left for horizontal positive positioning relative to fixed arm 6 (FIG. 4).

Cartridge 1 is inserted or installed on carrier 2 by first placing trunnion 5 in the hole 26 of fixed retaining arm 6. This is done by holding cartridge 1 inclined as shown in FIG. 1. Refer now to FIG. 5 which is a view of fixed retaining arm 6 taken along section line 5—5 in FIG. 4. The hole 26 in fixed retaining arm 6 is designed such that it has a vertical elliptical or elongated configuration 27 as seen in an inclined position for inserting trunnion 5 in that hole 26, and has a completely round configuration 28 as seen in the direction of tilting axis 4, so that there is no clearance sideways and vertically after complete insertion of the cartridge 1, and therefore an exact positioning is secured. Then, when trunnion 5 is in this hole 26 of fixed retaining arm 6 the right part of cartridge 1 is lowered and flexible arm 3 is deflected to the right in accordance with arrow 16 on top of handle 9 (FIG. 4). Cartridge 1 is pressed down against the biasing action of protruding leg 12 far enough until tenon 8 is able to snap into recess 7 of cartridge 1. The biasing force of the leaf spring action of holding arm 10 biases cartridge 1 to the left for positioning it horizontally. The combined biasing force of protruding leg 12 attached to upright standing holding arm 10 and of holding arm 10 itself, those forces acting against each other, presses recess 7 of cartridge 1 against the lower part of tenon 8. Thus cartridge 1 is also positively positioned vertically.

Removing cartridge 1 from carrier 2 just requires the operator to push or deflect handle 9 of flexible retaining arm 3 to the right in direction of arrow 16 so that tenon 8 clears recess 7. The biasing force of protruding leg 12 pushes up cartridge 1 for final and easy removal by the operator. The deflecting action of holding arm 10 in the direction of arrow 16 actually enforces the lifting strength of protruding leg 12.

The depicted and preferred design of flexible retaining arm 3 (FIG. 2) includes U-shaped base 11 formed out of the lower part of holding arm 10 and outer short leg 13, and protruding leg 12, all made as a leaf spring out of spring steel. Handle 9 around the upper part of holding arm 10 includes tenon 8 and is preferably made out of plastic material cast around the upper part of holding arm 10.

Figure 1A:
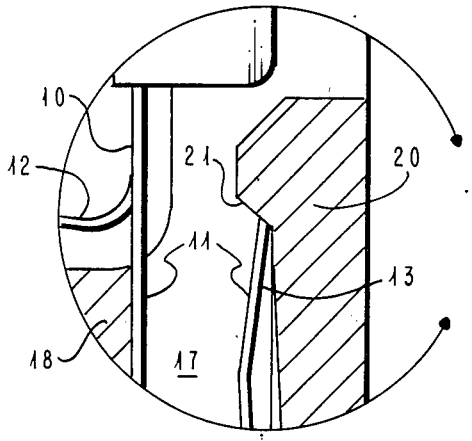
FIG. 1A is an enlarged detail of area A of FIG. 1.

U-shaped base 11 of retaining arm 3 fits into a recess or an opening 17 provided on carrier 2. This recess 17 has a vertical inner wall 18 that guides holding arm 10 such that it stands essentially upright relative to carrier 2 and can be deflected to the right. Recess 17 furthermore has a bottom 19 on which the apex of the U-shaped base 11 rests. Then an outer wall 20 (FIG. 1) restricts recess 17 to the right outside of carrier 2. Outer wall 20 is provided with a slanted overhang 21. This slanted overhang 21 narrows recess 17 on its entry side. The end of shorter outer leg 13 of retaining arm 3 abuts against the slanted surface of overhang 21 and thus holds itself inside recess 17 because outer leg 13 tends to expand inside recess 17 and therefore pushes its upper tip against that slanted overhang 21. As can be seen in FIG. 1A the upper part of outer leg 13 is bent away from holding arm 10 such that its tip includes a larger angle with slanted overhang 21. In this manner retaining 3 is more firmly engaged within the carrier recess (17). This design also accommodates slight deviations in the lengths of outer leg 13. The only decisive measure is the distance between tenon 8 and bottom 19 of recess 17 or the apex of U-shaped base 11, respectively.

The above described design provides the additional advantage of being so simple as to be easily assembled using modern automated assembly techniques. It is within the skill of the automated manufacturing engineer to provide a tool to accomplish such assembly.

Such a tool would grasp one arm 3 from a supply thereof provided and insert it in the opening 17 in correct orientation and to push it down until the apex of base 11 rests on bottom 19. The tip of outer leg 13 automatically expands and, resting on slanted overhang 21, fixes retaining arm 3 without the need for any other fixing means.

Still another modification (not shown) to the disclosed ribbon cartridge retention mechanism contemplates attaching holding arm 10 to vertical wall 18 using conventional connecting techniques such as a screw. Such a design would also allow holding arm 10 to deflect. In such a design no U-shaped base 11 and recess 17 would be necessary.

While this invention has been particularly shown and described with reference to a preferred embodiment thereof, it will be understood by those skilled in the art that the foregoing and other changes in form and detail may be made therein without departing from the spirit and scope of the invention.

I claim:

1. A ribbon cartridge retention means for holding a ribbon cartridge (1) detachably in place on a carrier (2) of a printer, typewriter or the like, said ribbon cartridge being tiltable around an axis (4) parallel to the print line and comprising a trunnion (5) on one edge and holding means on the opposite edge, said trunnion and said holding means being centered to said tilting axis, characterized in that (a) said retention means is comprised of a leaf spring (3), (b) said leaf spring includes a U-shaped base 11 having legs of unequal lengths that fits in a recess (17) provided in said carrier, (c) said U-shaped base and said recess are arranged such that a holding arm (10) of said leaf spring stands upright from said carrier, (d) a tenon (8) is provided on said upright standing holding arm of said leaf spring at said tilting axis, (e) said tenon snapping in a recess (7) provided in said holding means of said cartridge when said cartridge is inserted in place on said carrier whereby said tenon first has been bent out of the way against the biasing force of said holding arm, (f) said leaf spring further includes a leg (12) that protrudes toward said edge of said cartridge carrying said trunnion, and (g) said protruding leg in its unstressed state protrudes slightly away from said carrier and in its stressed state, when said cartridge is put in place on said carrier, biases said cartridge upwardly against said tenon of said holding arm and biases said cartridge so as to provide lifting force for pushing said cartridge out of its place when said tenon is removed out of said recess of said cartridge upon bending said biasing holding arm away from said cartridge.

2. Cartridge retention means of claim 1, wherein said leaf spring with said U-shaped base, said holding arm and said protruding lifting leg is made out of one single piece of spring steel material.

3. The ribbon cartridge retention means of claim 1, wherein said leg protruding toward said cartridge protrudes at an angle relative to said cartridge tilting axis so that said cartridge is biased with a moment of rotation.

4. The ribbon cartridge retention means of claim 3, wherein said leg protruding toward said cartridge is bent in a direction towards a ribbon exposing part (14) of said cartridge so that the remaining part on the opposite side of said tilting axis is biased rotationally toward said carrier.

5. The ribbon cartridge retention means of claim 1, wherein said protruding leg is fixed to said holding arm of said leaf spring.

6. The ribbon cartridge retentioning means of claim 1, wherein a handle (9) is provided on top of said holding arm.

7. The ribbon cartridge retention means of claim 6, wherein said handle is made out of plastic material cast around said upper part of said holding arm of said leaf spring.

8. The ribbon cartridge retention means of claim 7, wherein said tenon is incorporated into said cast plastic handle.

9. The ribbon cartridge retention means of claim 1, wherein said recess of said carrier in which said U-shaped base of said leaf spring is confined, is provided with a slanted overhang (21) on one side of its opening to retain a short leg (13) of said U-shaped base within its place without further fixing means and to position said U-shaped base exactly.

10. The ribbon cartridge retention means of claim 9, wherein the free end of said short leg of said U-shaped spring base is bent toward said slanted overhang for including a larger angle.

11. A ribbon cartridge retention means for holding a ribbon cartridge (1) detachably in place on a carrier (2) of a printer, typewriter or the like, said ribbon cartridge being tiltable around an axis (4) parallel to the print line and comprising a trunnion (5) on one edge and holding means on the opposite edge, said trunnion and said holding means being centered to said tilting axis, characterized in that (a) said retention means includes a leaf spring (3), (b) said leaf spring is fixed such as to said carrier that said leaf spring forms a holding arm (10) which stands essentially upright from said carrier, (c) a tenon (8) is provided on said holding arm at said tilting axis, (d) said tenon snapping in a recess (7) provided in said holding means of said cartridge when said cartridge is inserted in place on said carrier whereby said tenon first has been bent out of the way against the biasing force of said holding arm, (e) said leaf spring further includes a leg (12) that protrudes toward said edge of said cartridge carrying said trunnion, (f) said protruding leg in unstressed state protrudes slightly away from said carrier and in stressed state, when said cartridge is put in place on said carrier, biases said cartridge upward against said tenon of said holding arm and biases said cartridge so as to provide lifting force for pushing said cartridge out of its place when said tenon is removed out of said recess of said cartridge upon bending said biasing holding arm away from said cartridge.

* * * * *